US011221142B2

(12) United States Patent
Shim et al.

(10) Patent No.: US 11,221,142 B2
(45) Date of Patent: Jan. 11, 2022

(54) FUEL NOZZLE ASSEMBLY AND GAS TURBINE HAVING THE SAME

(71) Applicant: DOOSAN HEAVY INDUSTRIES & CONSTRUCTION CO., LTD., Changwon-si (KR)

(72) Inventors: Youngsam Shim, Busan (KR); Ujin Roh, Changwon-si (KR); Dongsik Han, Changwon-si (KR); Jae Won Seo, Bucheon-si (KR)

( * ) Notice: Subject to any disclaimer, the term of this patent is extended or adjusted under 35 U.S.C. 154(b) by 1 day.

(21) Appl. No.: 15/714,771

(22) Filed: Sep. 25, 2017

(65) Prior Publication Data

US 2018/0299128 A1 Oct. 18, 2018

(30) Foreign Application Priority Data

Apr. 18, 2017 (KR) ..... 10-2017-0049624

(51) Int. Cl.

| | |
|---|---|
| ***F23R 3/14*** | (2006.01) |
| ***F23R 3/10*** | (2006.01) |
| ***F23R 3/26*** | (2006.01) |
| ***F23R 3/28*** | (2006.01) |
| ***F23D 14/48*** | (2006.01) |
| ***F23R 3/54*** | (2006.01) |
| *F23R 3/00* | (2006.01) |

(52) U.S. Cl.

CPC ..... *F23R 3/10* (2013.01); *F23D 14/48* (2013.01); *F23R 3/14* (2013.01); *F23R 3/26* (2013.01); *F23R 3/283* (2013.01); *F23R 3/286* (2013.01); *F23R 3/54* (2013.01); *F23C 2900/07001* (2013.01); *F23D 2900/14701* (2013.01); *F23R 3/002* (2013.01)

(58) Field of Classification Search

CPC .. F23R 3/283; F23R 3/286; F23R 3/14; F23R 3/26

See application file for complete search history.

(56) References Cited

U.S. PATENT DOCUMENTS

| | | | | |
|---|---|---|---|---|
| 2,558,816 A * | 7/1951 | Bruynes | ..... | B64C 23/06 138/37 |
| 4,175,640 A * | 11/1979 | Birch | ..... | F02K 1/386 181/213 |
| 5,540,406 A | 7/1996 | Occhipinti | | |
| 2007/0113555 A1 * | 5/2007 | Carroni | ..... | F23R 3/286 60/737 |

(Continued)

FOREIGN PATENT DOCUMENTS

| | | |
|---|---|---|
| CN | 104566459 A | 4/2015 |
| EP | 2568221 A2 | 3/2013 |

(Continued)

*Primary Examiner* — Thomas P Burke

(74) *Attorney, Agent, or Firm* — Harvest IP Law, LLP

(57) ABSTRACT

A fuel nozzle assembly and a gas turbine having the fuel nozzle assembly includes a fuel nozzle guide disposed in a compressed air channel formed between a body and a housing of a gas turbine and includes a nozzle body disposed in the housing, a shroud mounted on an outer side of the nozzle body, and two or more flow guides arranged at predetermined distances from each other between the shroud and the outer side of the nozzle body and formed to correspond to the shape of an end of the shroud and the shape of the outer surface of the nozzle body.

17 Claims, 11 Drawing Sheets

(56) References Cited

U.S. PATENT DOCUMENTS

| | | | | |
|---|---|---|---|---|
| 2009/0173074 | A1* | 7/2009 | Johnson | F23R 3/10 60/737 |
| 2009/0183511 | A1* | 7/2009 | Dinu | F23R 3/14 60/737 |
| 2011/0094232 | A1* | 4/2011 | Stewart | F23R 3/14 60/734 |
| 2012/0024985 | A1* | 2/2012 | Johnson | F23R 3/14 239/518 |
| 2012/0045725 | A1* | 2/2012 | Takiguchi | F23R 3/14 431/60 |
| 2013/0025285 | A1* | 1/2013 | Stewart | F02C 7/2365 60/740 |
| 2013/0061594 | A1* | 3/2013 | Stewart | F23R 3/10 60/740 |
| 2015/0113993 | A1 | 4/2015 | Rudrapatna et al. | |
| 2017/0184308 | A1* | 6/2017 | Valeev | F02C 3/04 |

FOREIGN PATENT DOCUMENTS

| | | | |
|---|---|---|---|
| JP | 2012145312 | A | 8/2012 |
| JP | 6037812 | B2 | 12/2016 |
| KR | 10-2009-0127353 | A | 12/2009 |
| KR | 10-2016-0069805 | A | 6/2016 |
| WO | 2016-209101 | A1 | 12/2016 |

* cited by examiner

FUEL NOZZLE ASSEMBLY AND GAS TURBINE HAVING THE SAME

CROSS REFERENCE TO RELATED APPLICATION

The present application claims priority to Korean Patent Application No. 10-2017-0049624, filed Apr. 18, 2017, the entire contents of which is incorporated herein by reference.

BACKGROUND

The present invention relates to a fuel nozzle assembly and a gas turbine having the same and, more particularly, to a fuel nozzle assembly that is disposed in a compressed air channel formed between the body of a combustor and a housing in a gas turbine, and a gas turbine having the fuel nozzle assembly.

In general, as shown in FIG. 1, a gas turbine 1 includes a compressor 11, a combustor 12, and a turbine 13. Air flowing inside through an air inlet 20 is compressed into high-temperature and high-pressure compressed air by the compressor. High-temperature and high-pressure combustion gas (working fluid) is produced by combusting the compressed air by supplying fuel to the compressed air. The turbine is operated by the combustion gas, and a power generator connected to the turbine is operated.

As shown in FIG. 2, a combustor 12 of gas turbine 1, includes a plurality of main burners 45 disposed around a pilot burner 44, a pilot nozzle disposed in the pilot burner 44, and a main nozzle disposed in the main burners 45. Further, the pilot burner 44 and the main burners 45 are arranged in the combustor 12 to face a combustion chamber 43 of the gas turbine.

FIG. 3 is a partial cross-sectional view showing a combustor nozzle assembly 10. Referring to FIG. 3, the fuel nozzle assembly 10 guides suctioned compressed air using a shroud 14 mounted on the outer side of a nozzle body 11.

However, fluid separation may be generated on the shroud 14 fuel-air mixture may stagnate due to a vortex area around a nozzle vane or swirler (not shown. Accordingly, flame may be generated around the nozzle vane.

Further, in the shroud 14, a loss of pressure is generated by flow separation, which causes deterioration of the entire performance of the combustor. Therefore, there is a need to develop a fuel nozzle assembly that can solve the problems in the related art.

SUMMARY

An object of the present invention is to provide a fuel nozzle assembly that can solve flame holding due to flow separation at an end of the shroud of existing fuel nozzles, can improve performance of a combustor, and can solve a loss of pressure in the entire combustor by preventing a loss of pressure due to flow separation by preventing the flow separation, and provide a gas turbine having the fuel nozzle assembly.

A fuel nozzle guide according to an aspect is disposed in a compressed air channel formed between a body and a housing of a gas turbine and includes a nozzle body disposed in the housing, a shroud mounted on an outer side of the nozzle body, and two or more flow guides arranged at predetermined distances from each other between the shroud and the outer surface of the nozzle body, and formed to correspond to the shape of an end of the shroud and the shape of the outer surface of the nozzle body.

The flow guides may have a curved portion formed to correspond to the shape of an end of the shroud and a straight portion extending from the curved portion at a predetermined portion in a longitudinal direction of the nozzle body in parallel with the outer surface of the nozzle body.

A first projection extending in the longitudinal direction of the nozzle body may be formed on a surface of the curved portion.

The first projection may be inclined at a predetermined angle.

A second projection extending in the longitudinal direction of the nozzle body may be formed on a surface of the straight portion.

The first projection and the second projection may integrally extend.

Two or more sub-channels spaced at a predetermined angle from each other may be formed through a joint between the curved portion and the straight portion of the flow guide.

The sub-channel may be formed in parallel with the straight portion.

An imaginary line connecting all of ends of the flow guides may be inclined at an acute angle toward a center of the nozzle body.

The angle between the imaginary line and a center line of the nozzle body may be 35 to 55 degrees.

The fuel nozzle assembly may further include two or more spacers arranged at predetermined angles on the outer surface of the nozzle body and connecting the flow guides and the nozzle body to each other.

The spacers may extend a predetermined distance in the longitudinal direction of the nozzle body and may have an airfoil shape in a side cross-section.

The spacers may extend at a predetermined angle from the center line of the nozzle body.

A gas turbine according to another aspect has a fuel nozzle guide that is disposed in a compressed air channel formed between a body and a housing of a gas turbine, and the fuel nozzle assembly includes a nozzle body disposed in the housing, a shroud mounted on an outer side of the nozzle body, and two or more flow guides arranged at predetermined distances from each other between the shroud and the outer surface of the nozzle body and formed to correspond to the shape of an end of the shroud and the shape of the outer surface of the nozzle body.

The flow guides may have a curved portion formed to correspond to the shape of an end of the shroud and a straight portion extending from the curved portion at a predetermined portion in a longitudinal direction of the nozzle body in parallel with the outer surface of the nozzle body.

An imaginary line connecting all of ends of the flow guides may be inclined at an acute angle toward a center of the nozzle body.

The fuel nozzle assembly may further include two or more spacers arranged at predetermined angles on the outer surface of the nozzle body and connecting the flow guides and the nozzle body to each other.

As described above, according to the fuel nozzle assembly of the present disclosure, it is possible to provide a fuel nozzle assembly that can solve a loss of pressure due to flow separation by preventing flow separation and solve a loss of pressure of the entire combustor, and a gas turbine having the fuel nozzle assembly.

Further, according to the fuel nozzle assembly of the present disclosure, since flow separation is prevented by the flow guides having a specific structure, it is possible to solve flame holding due to flow separation at an end of a shroud of existing fuel nozzles and improve the performance of a combustor.

Further, according to the fuel nozzle assembly of the present disclosure, since the flow guides have a curved portion and a straight portion, it is possible to more stably guide fluid flowing along the flow guides, so it is possible to effectively prevent flow separation.

Further, according to the fuel nozzle assembly of the present disclosure, since the first projections and the second projections are formed at specific positions, it is possible to more stably guide fluid flowing along the flow guides, so it is possible to effectively prevent flow separation.

Further, according to the fuel nozzle assembly of the present disclosure, since sub-channels having a specific structure are formed at the joints between the curved portions and the straight portions, it is possible to prevent flow separation that may be generated at the joints between the curved portions and the straight portions and it is possible to more stably guide the fluid flowing along the flow guides. Accordingly, it is possible to more effectively prevent flow separation.

Therefore, according to the fuel nozzle assembly of the present disclosure, since there are provided spacers having a specific structure, it is possible to more stably guide fluid flowing along the flow guides, so it is possible to effectively prevent flow separation.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION

Hereinafter, the exemplary embodiments are described in detail with reference to the drawings. The terms and words used in the present specification and claims should not be interpreted as being limited to typical meanings or dictionary definitions, but should be interpreted as having meanings and concepts relevant to the technical scope of the present invention.

It should be understood that when an element is referred to as being "on" another element, the elements may be in contact with each other or there may be an intervening element present. Through the present specification, unless explicitly described otherwise, "comprising" any components will be understood to imply the inclusion of other components rather than the exclusion of any other components.

Figure 1:
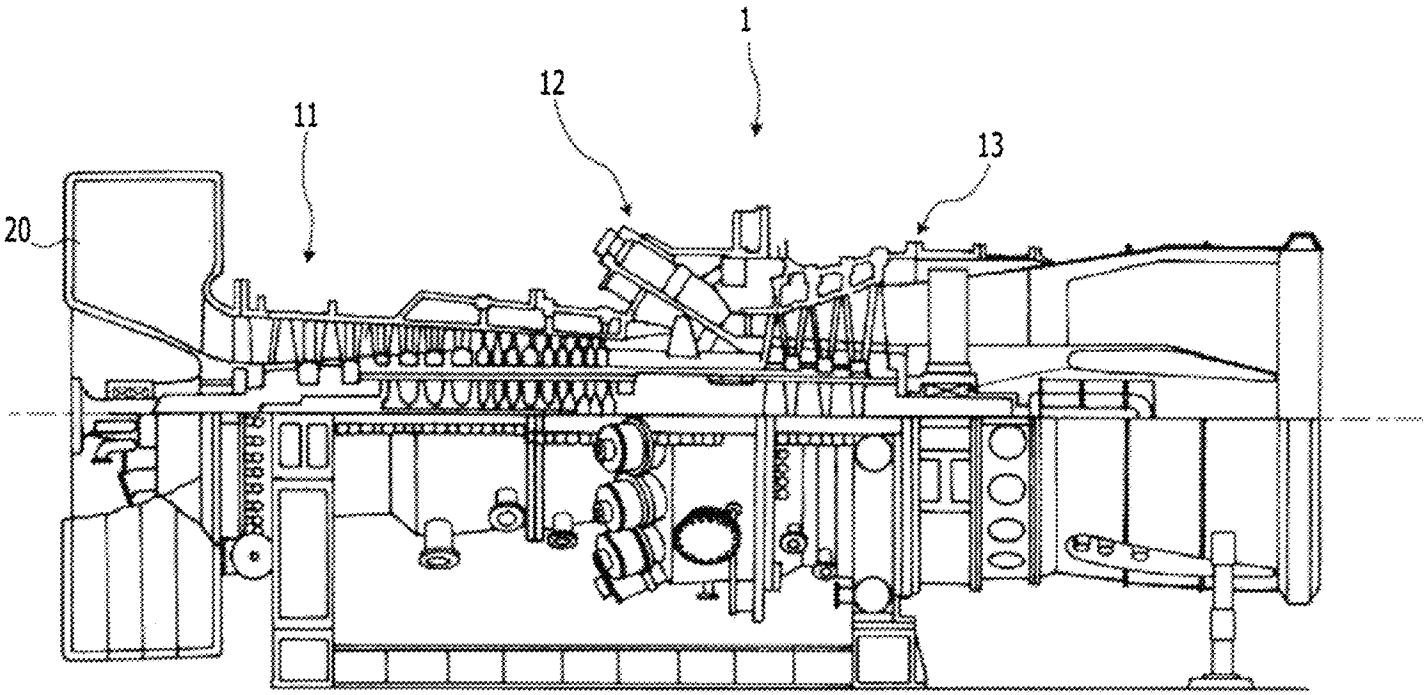
FIG. 1 is a front view showing a gas turbine.
Figure 2:
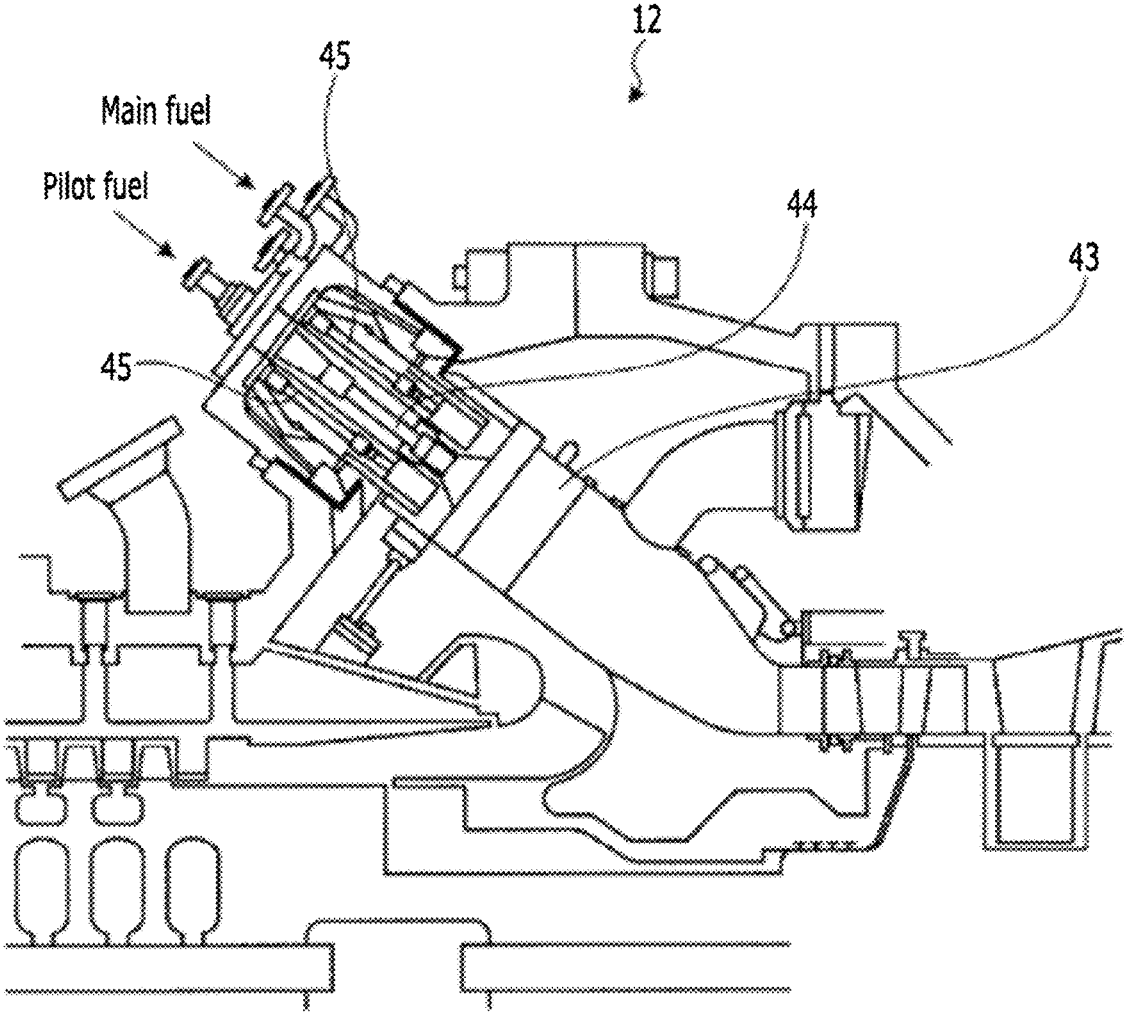
FIG. 2 is a partial cross-sectional view showing the combustor shown in FIG. 1.
Figure 3:
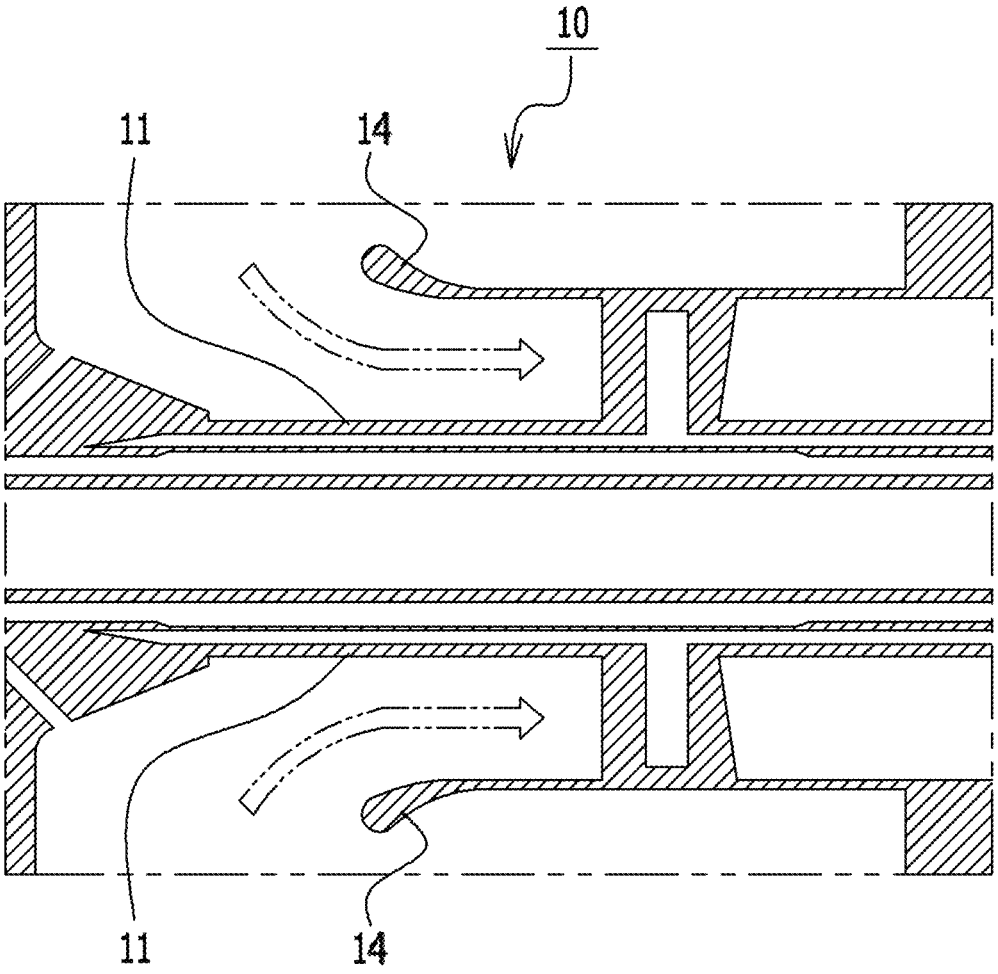
FIG. 3 is a partial cross-sectional view showing a fuel nozzle assembly.
Figure 4:
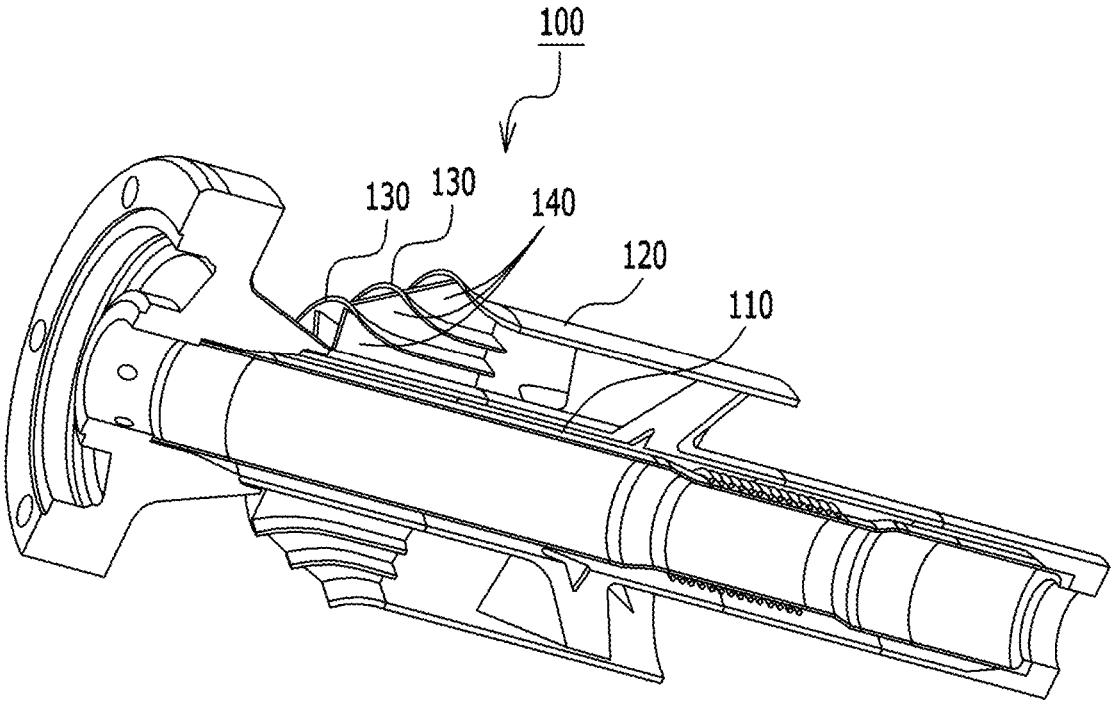
FIG. 4 is a partial cross-sectional perspective view showing a fuel nozzle assembly according to an exemplary embodiment.

FIG. 4 is a partial cross-sectional perspective view showing a fuel nozzle assembly according to an exemplary embodiment. Referring to FIG. 4, a fuel nozzle assembly 100 according to the exemplary embodiment, which is disposed in a compressed air channel formed between the body of a combustor and a housing of a gas turbine, includes flow guides 130 having a specific structure. The fuel nozzle assembly 100 according to the exemplary embodiment includes flow guides 130 having a specific structure to provide a fuel nozzle assembly 100 that can solve a loss of pressure in the entire combustor by preventing a loss of pressure due to flow separation by preventing a flow separation, and provide a gas turbine having the fuel nozzle assembly.

The components of the fuel nozzle assembly 100 according to the exemplary embodiment are described hereafter in detail with reference to the drawings.

Figure 5:
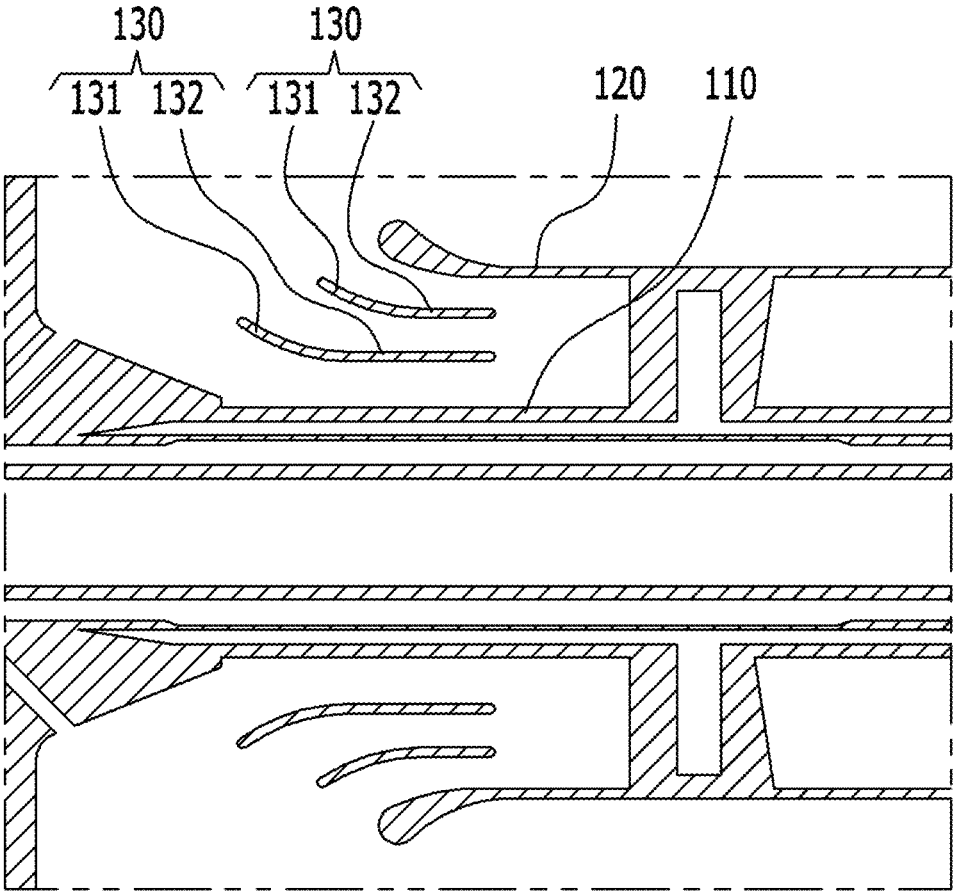
FIG. 5 is a partial cross-sectional view showing the fuel nozzle assembly according to an exemplary embodiment.
Figure 6:
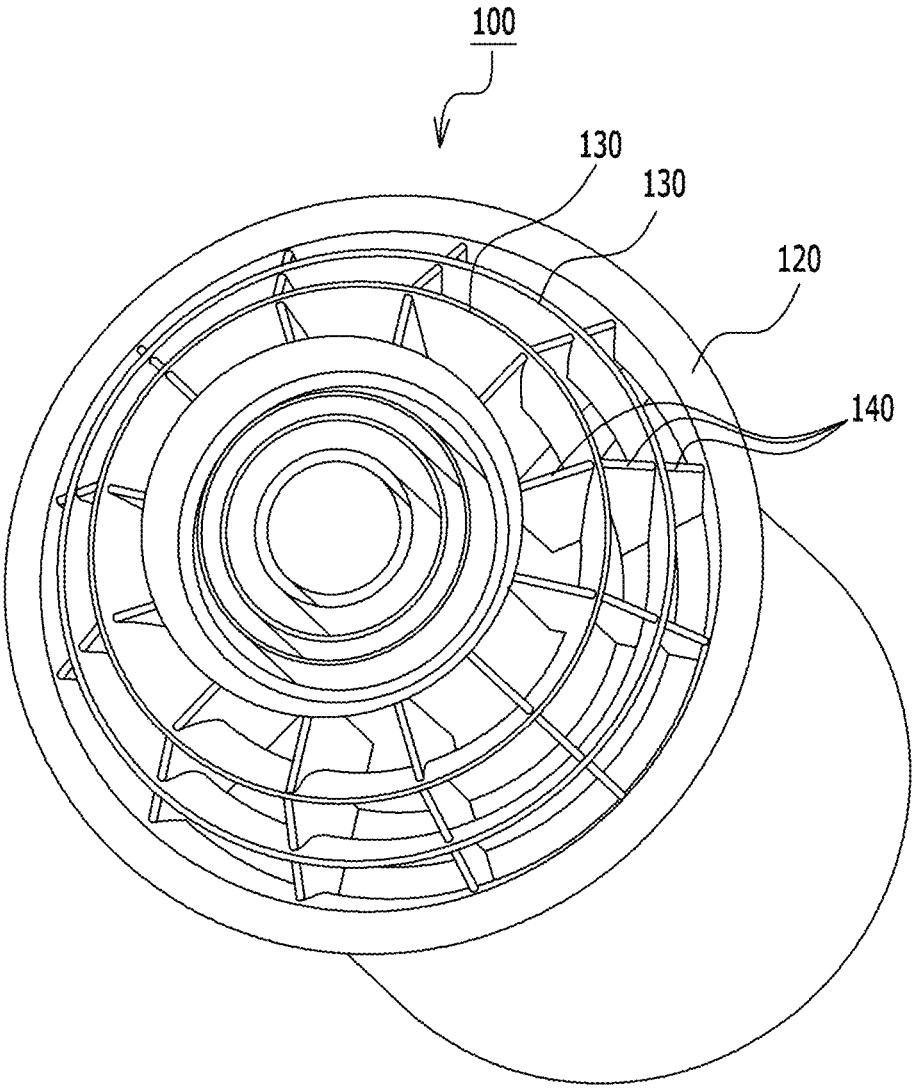
FIG. 6 is a perspective view showing the fuel nozzle assembly according to an exemplary embodiment.
Figure 7:
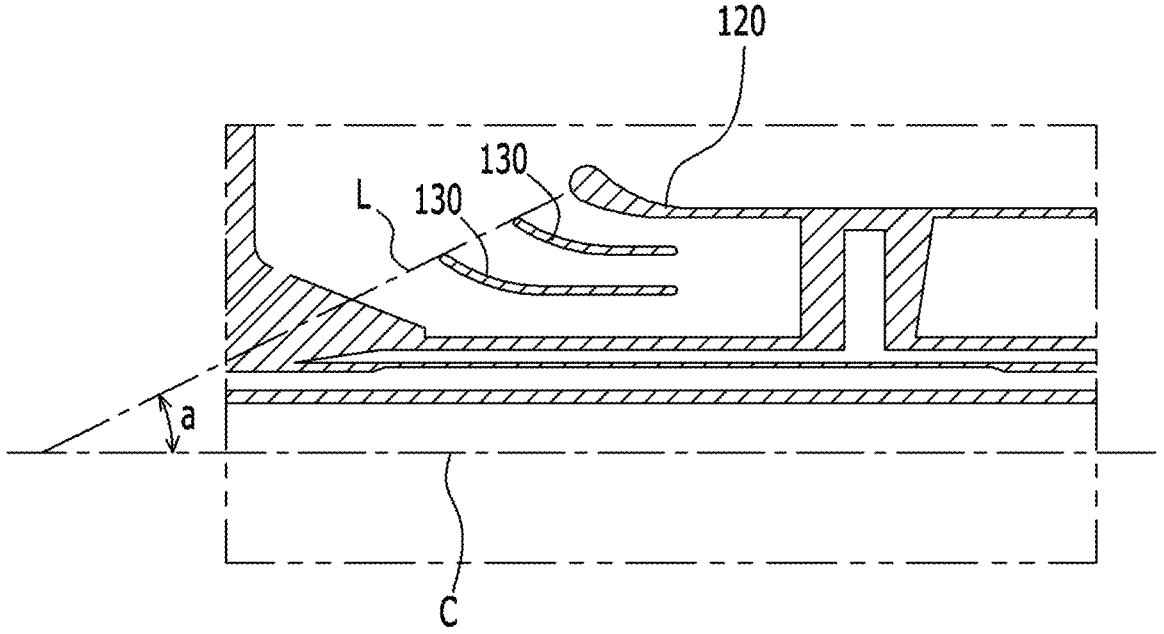
FIG. 7 is a partial cross-sectional view showing in detail the structure of a flow guide of the fuel nozzle assembly shown in FIG. 5.

FIG. 5 is a partial cross-sectional view showing the fuel nozzle assembly according to an exemplary embodiment. FIG. 6 is a perspective view showing the fuel nozzle assembly according to an exemplary embodiment. FIG. 7 is a partial cross-sectional view showing in detail the structure of a flow guide of the fuel nozzle assembly shown in FIG. 5.

Referring to the figures, the fuel nozzle assembly 100 according to the exemplary embodiment includes a nozzle body 110, a shroud 120, and flow guides 130.

The nozzle body 110 has a fuel supply channel for supplying fuel and is disposed in the housing. The shroud 120 is mounted on the outer side of the nozzle body 110.

Two or more flow guides 130 according to the exemplary embodiment are arranged at regular intervals between the shroud 120 and the outer surface of the nozzle body 110. The flow guides 130 are curved to correspond to the shape of an end portion of the shroud 120 and then formed straight to correspond the shape of the outer surface of the nozzle body 110, which is advantageous in terms of flow. The surfaces of the flow guides 130 may be composed of a curved surface and a straight surface that are smoothly connected.

As shown in FIG. 5, the flow guides 130 each may have a curved portion 131 and a straight portion 132 that have specific structures. The curved portion 131, as shown in FIGS. 4 and 5, is formed to correspond to the shape of an end portion of the shroud 120. The straight portion 132 extends from the curved portion 131 at a predetermined length in parallel with the nozzle body 110 and may be in parallel with the outer surface of the nozzle body 110. Two or more flow guides 130 according to the exemplary embodiment may be formed around the outer surface of the nozzle body 110.

As shown in FIG. 7, an imaginary line L connecting ends of the flow guides 130 may be inclined at an acute angle toward the center of the nozzle body 110. The angle 'a' between the imaginary line L and the center line C of the nozzle body 110 may be 35 to 55 degrees but may be a different angle as long as compressed air can be smoothly suctioned.

As the angle between the imaginary line connecting all the ends of the flow guides 130 and the center line of the nozzle body 110 is an acute angle, the curved portions 131 of the flow guides 130 closer to the nozzle body 110 further protrude with respect to the flow of compressed air. As can be seen from FIG. 7, in order to smoothly change the direction of the flow of compressed air that is turned almost 180°, the compressed air far from the nozzle body 110 should be guided to the inner flow guides 130 through the shroud 120. For more effective flow of compressed air, the flow guides 130 closer to the nozzle body 110 should guide the outside flow, so it is advantageous that the curved portions 131 of the inner flow guide 130 further protrude to the flow of the compressed air.

Figure 8:
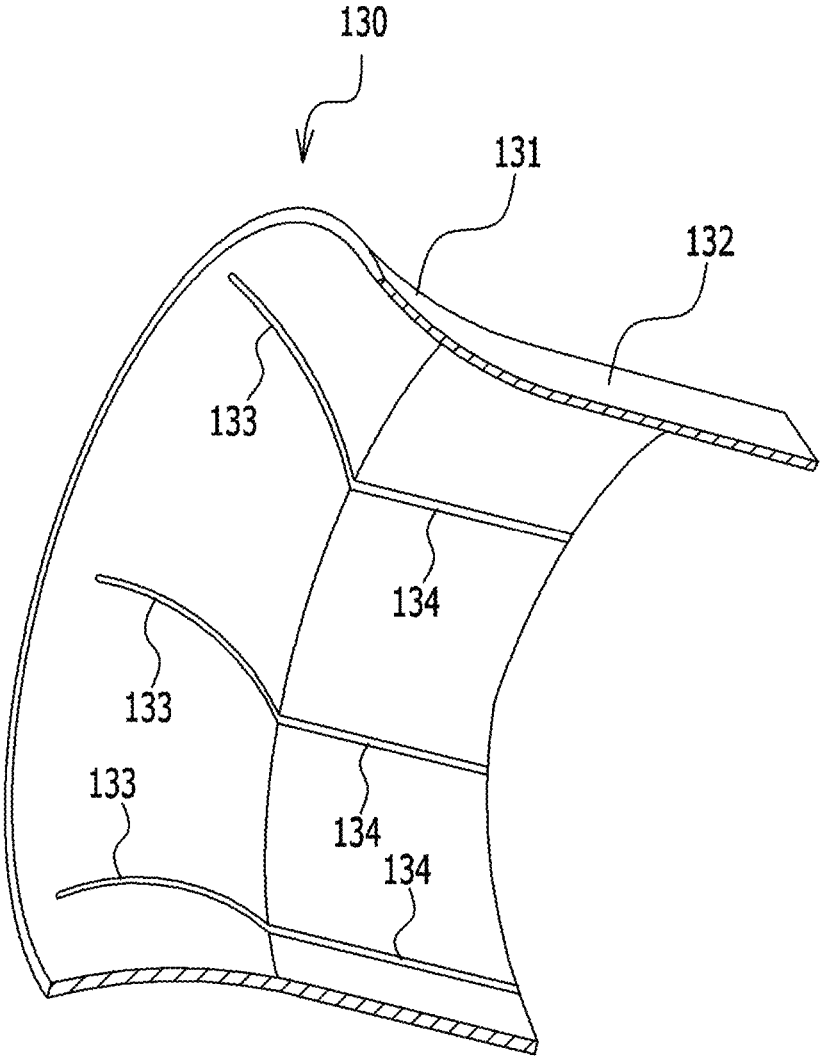
FIG. 8 is a cross-sectional perspective view showing the flow guides of the fuel nozzle assembly according to an exemplary embodiment.

FIG. 8 is a cross-sectional perspective view showing the flow guides of the fuel nozzle assembly according to an exemplary embodiment. Referring to FIG. 8, a first projection 133 extending in the longitudinal direction of the nozzle body 110 is formed on a surface of the curved portions 131 of the flow guides 130 according to the exemplary embodiment. The first projection 133 can stably guide the flow flowing on the curved portion 131, so it can effectively prevent flow separation.

If necessary, the first protrusion 133, as shown in FIG. 8, may be inclined at a predetermined angle from the center line of the nozzle body 110. Accordingly, it is possible to stably guide fluid into a desired direction.

Further, as shown in FIG. 8, a second projection 134 extending in the longitudinal direction of the nozzle body 110 is formed on a surface of the straight portions 132, so it can more stably guide fluid. In this case, the first projection 133 and the second projection 134 may integrally extend. If the first projection 133 and the second projection 134 are separately formed, flow separation of fluid may be generated at the spaced ends, so it is not advantageous.

Figure 9:
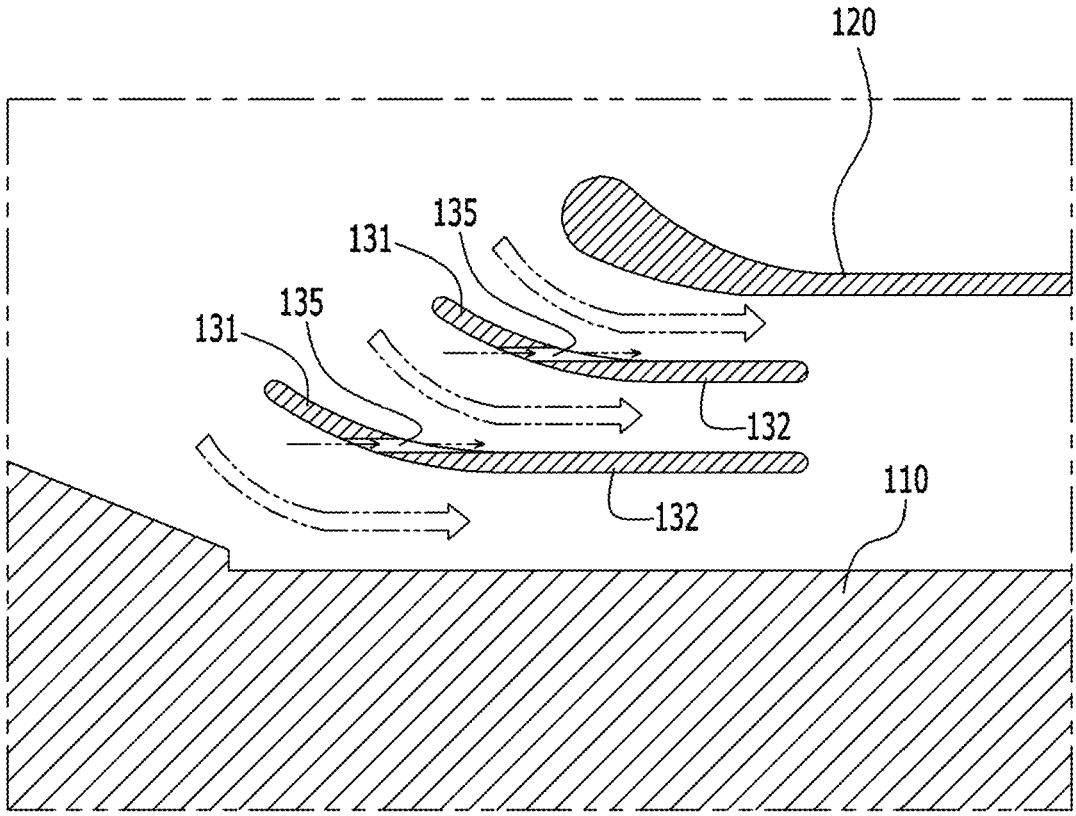
FIG. 9 is a partial cross-sectional view showing a fuel nozzle assembly according to another exemplary embodiment.

FIG. 9 is a partial cross-sectional view showing a fuel nozzle assembly according to another exemplary embodiment. Referring to FIG. 9, two or more sub-channels 135 are formed through the joints of the curved portions 131 and the straight portions 132 of the flow guides 130 according to the exemplary embodiment. The sub-channels 135 may be formed in parallel with the straight portions 132.

Since the sub-channels 135 having a specific structure are formed at the joints between the curved portions 131 and the straight portions 132, it is possible to prevent flow separation that may be generated at the joints between the curved portions 131 and the straight portions 132 and it is possible to more stably guide the fluid flowing along the flow guides. Accordingly, it is possible to more effectively prevent flow separation.

Figure 10A:
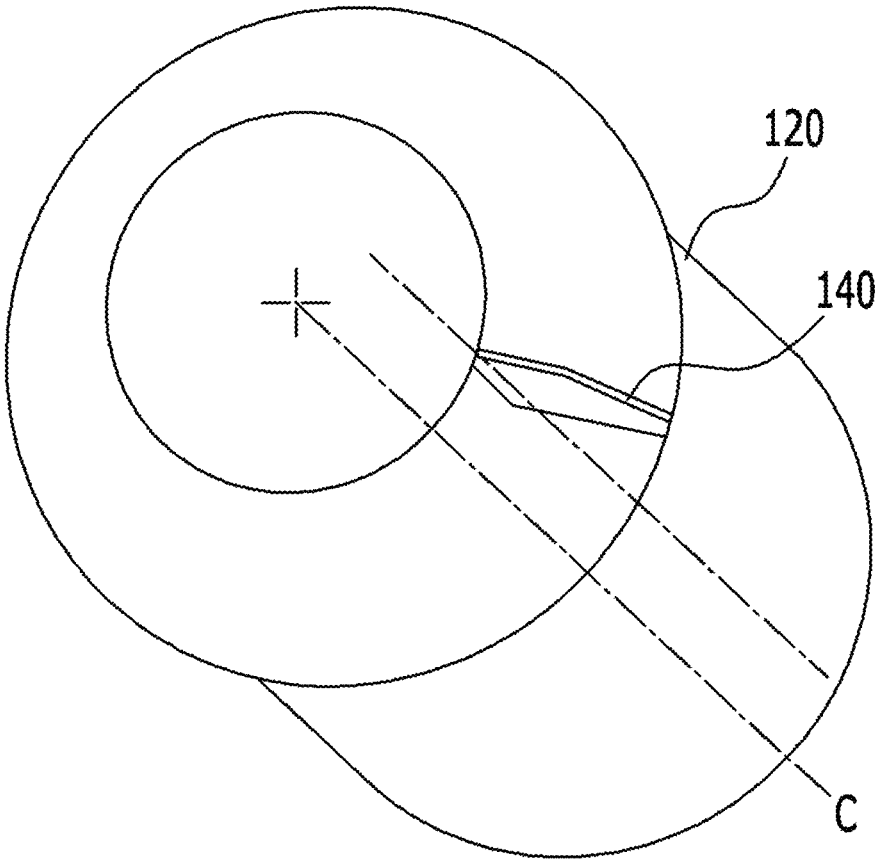
FIGS. 10A and 10B are perspective views showing a spacer of the fuel nozzle assembly according to another exemplary embodiment.
Figure 10B:
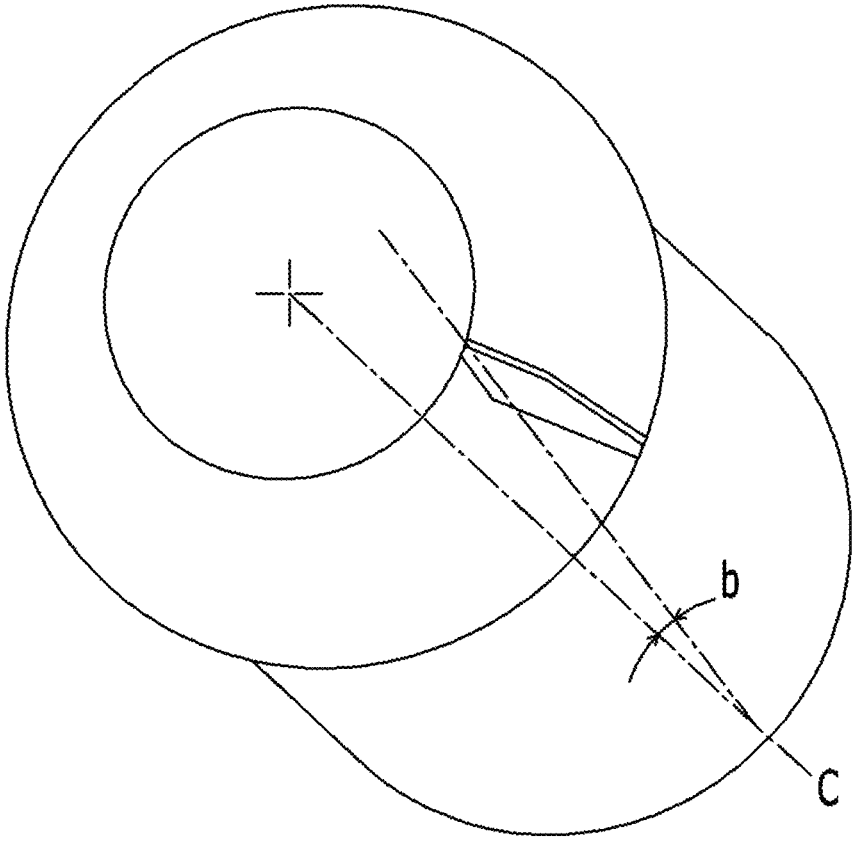

FIGS. 10A and 10B are perspective views showing a spacer of the fuel nozzle assembly according to another exemplary embodiment. Referring to FIGS. 10A and 10B with FIG. 6, the fuel nozzle assembly according to the exemplary embodiment may further include spacers 140 connecting the flow guides 130 and the nozzle body 110.

Two or more spacers 140 according to the exemplary embodiment may be formed around the outer surface of the nozzle body 110 at predetermined angles. The spacers 140 extend a predetermined length in the longitudinal direction of the nozzle body 110 and may have an airfoil shape in a side cross-section.

As shown in FIG. 10A, the spacers 140 according to the exemplary embodiment may extend in parallel with the center line C of the nozzle body 110. In order to guide flow in a specific direction, the spacers 140 may be mounted at a predetermined angle 'b' from the center line C of the nozzle body 110 as shown in FIG. 10B.

Therefore, according to the exemplary embodiment, the spacers 140 having a specific structure more stably guide fluid flowing along the flow guides 130, so it is possible to effectively prevent flow separation.

Further, the exemplary embodiments can provide a gas turbine having the fuel nozzle assembly 100 according to the present disclosure, so it is possible to provide a gas turbine of which the performance of the combustor can be remarkably improved and the efficiency is improved.

Specific exemplary embodiments were described above. However, it should understood that the present disclosure is not limited to the specific exemplary embodiments and all modifications, equivalents, and substitutions should be construed as being included in the scope of the present disclosure as defined in claims.

That is, the present disclosure is not limited to the specific exemplary embodiments described above, but may be changed in various ways without departing from the spirit of the present disclosure as defined in claims, and the modifications are included in the protective range of the present disclosure.

What is claimed is:

1. A fuel nozzle assembly for a gas turbine, comprising:

a nozzle body configured to be disposed in a compressed air channel formed between a body and a housing of the gas turbine;

a shroud mounted on an outer surface of the nozzle body; and two or more flow guides disposed between the shroud and the outer surface of the nozzle body and arranged at predetermined distances from each other in a radial direction of the nozzle body, each of the two or more flow guides being configured to guide compressed air of the compressed air channel into the shroud and comprising:

a curved portion having a curved shape that corresponds to a curved shape of an end portion of the shroud;

a straight portion having a longitudinal shape that corresponds to the outer surface of the nozzle body, the straight portion extending from one end of the curved portion in a longitudinal direction of the nozzle body;

a first projection that is formed on a radial inner surface of the curved portion to protrude radially inward, that extends in the longitudinal direction of the nozzle body, and that includes a first projection end distanced from the radial inner surface of the curved portion in the radial direction, a second projection that is formed on a radial inner surface of the straight portion to protrude radially inward, that extends in the longitudinal direction of the nozzle body, and that includes a second projection end distanced from the radial inner surface of the straight portion in the radial direction, wherein the first and second projections are configured to prevent flow separation by stably guiding a flow of the compressed air flowing on the two or more flow guides, wherein the first projection of each of the two or more flow guides includes a first longitudinal end and a second longitudinal end that is disposed opposite to the first longitudinal end at a downstream end of the curved portion and integrally extends from a corresponding second projection of each of the two or more flow guides, the first longitudinal end being separated in the longitudinal direction from an upstream end of the curved portion of a corresponding flow guide of the two or more flow guides, wherein the first longitudinal end is disposed at a location longitudinally separated from the upstream end of the curved portion and the second longitudinal end is disposed at a location at the downstream end of the curved portion that is integrated with a first longitudinal end of the corresponding second projection, and wherein the second projection of each of the two or more flow guides includes a first longitudinal end that is disposed at an upstream end of the straight portion and integrally extends from a corresponding second longitudinal end of a first projection of each of the two or more flow guides and a second longitudinal end that is disposed opposite to the first longitudinal end of the second projection at a downstream end of the straight portion, the second longitudinal end of the second projection extending to an end of the downstream end of the straight portion and being in contact with the downstream end of the straight portion of a corresponding flow guide of the two or more flow guides without a gap.

2. The fuel nozzle assembly of claim 1, wherein the straight portion extends from the curved portion a predetermined distance in the longitudinal direction and is formed to be parallel with the outer surface of the nozzle body.

3. The fuel nozzle assembly of claim 1, wherein a sub-channel is formed through a joint between the curved portion and the straight portion of the two or more flow guides.

4. The fuel nozzle assembly of claim 3, wherein the sub-channel is parallel with the straight portion.

5. The fuel nozzle assembly of claim 1, wherein the two or more flow guides are arranged such that ends of the two or more flow guides form an imaginary line that is inclined at an acute angle from the center line of the nozzle body.

6. The fuel nozzle assembly of claim 5, wherein the acute angle formed between the imaginary line and the center line of the nozzle body is between 35 to 55 degrees.

7. The fuel nozzle assembly of claim 1, further comprising two or more spacers connecting the two or more flow guides and the nozzle body to each other.

8. The fuel nozzle assembly of claim 7, wherein the two or more spacers extend a predetermined distance in the longitudinal direction of the nozzle body and have an airfoil shape in a side cross-section.

9. The fuel nozzle assembly of claim 7, wherein the two or more spacers extend at a predetermined angle from the center line of the nozzle body.

10. A gas turbine, comprising:

a compressed air channel formed between a body and a housing of the gas turbine; and a fuel nozzle assembly disposed in the compressed air channel, the fuel nozzle assembly including a nozzle body, a shroud mounted on an outer surface of the nozzle body, and two or more flow guides disposed between the shroud and the outer surface of the nozzle body and arranged at predetermined distances from each other in a radial direction of the nozzle body, each of the two or more flow guides being configured to guide compressed air of the compressed air channel into the shroud and comprising:

a curved portion having a curved shape that corresponds to a curved shape of an end portion of the shroud;

a straight portion having a longitudinal shape that corresponds to the outer surface of the nozzle body, the straight portion extending from one end of the curved portion in a longitudinal direction of the nozzle body;

a first projection that is formed on a radial inner surface of the curved portion to protrude radially inward, that extends in the longitudinal direction of the nozzle body, and that includes a first projection end distanced from the radial inner surface of the curved portion in the radial direction, a second projection that is formed on a radial inner surface of the straight portion to protrude radially inward, that extends in the longitudinal direction of the nozzle body, and that includes a second projection end distanced from the radial inner surface of the straight portion in the radial direction, wherein the first and second projections are configured to prevent flow separation by stably guiding a flow of the compressed air flowing on the two or more flow guides, wherein the first projection of each of the two or more flow guides includes a first longitudinal end and a second longitudinal end that is disposed opposite to the first longitudinal end at a downstream end of the curved portion and integrally extends from a corresponding second projection of each of the two or more flow guides, the first longitudinal end being separated in the longitudinal direction from an upstream end of the curved portion of a corresponding flow guide of the two or more flow guides, wherein the first longitudinal end is disposed at a location longitudinally separated from the upstream of the curved portion and the second longitudinal end is disposed at a location at the downstream end of the curved portion that is integrated with a first longitudinal end of the corresponding second projection, and wherein the second projection of each of the two or more flow guides incudes a first longitudinal end that is disposed at an upstream end of the straight portion and integrally extends from a corresponding second longitudinal end of a first projection of each of the two or more flow guides and a second longitudinal end that is disposed opposite to the first longitudinal end of the second projection at a downstream end of the straight portion, the second longitudinal end of the second projection extending to an end of the downstream end of the straight portion and being in contact with the downstream end of the straight portion of a corresponding flow guide of the two or more flow guides without a gap.

11. The gas turbine of claim 10, wherein the straight portion extends from the curved portion a predetermined distance in the longitudinal direction and is formed to be parallel with the outer surface of the nozzle body.

12. The gas turbine of claim 10, wherein the two or more flow guides are arranged such that ends of the two or more flow guides form an imaginary line that is inclined at an acute angle from the center line of the nozzle body.

13. The gas turbine of claim 10, further comprising two or more spacers connecting the two or more flow guides and the nozzle body to each other.

14. The gas turbine of claim 10, wherein a sub-channel is formed through a joint between the curved portion and the straight portion of the two or more flow guides.

15. The gas turbine of claim 14, wherein the sub-channel is parallel with the straight portion.

16. A fuel nozzle assembly for a gas turbine, comprising:

a nozzle body configured to be disposed in a compressed air channel formed between a body and a housing of the gas turbine;

a shroud mounted on an outer surface of the nozzle body; and two or more flow guides disposed between the shroud and the outer surface of the nozzle body and arranged at predetermined distances from each other in a radial direction of the nozzle body, each of the two or more flow guides being configured to guide compressed air of the compressed air channel into the shroud and comprising:

a curved portion having a curved shape that corresponds to a curved shape of an end portion of the shroud;

a straight portion having a longitudinal shape that corresponds to the outer surface of the nozzle body, the straight portion extending from one end of the curved portion in a longitudinal direction of the nozzle body;

a first projection that is formed on a radial inner surface of the curved portion to protrude radially inward, that extends in the longitudinal direction of the nozzle body, and that includes a first projection end distanced from the radial inner surface of the curved portion in the radial direction, a second projection that is formed on a radial inner surface of the straight portion to protrude radially inward, that extends in the longitudinal direction of the nozzle body, and that includes a second projection end distanced from the radial inner surface of the straight portion in the radial direction, wherein the first projection of each of the two or more flow guides includes a first longitudinal end and a second longitudinal end that is disposed opposite to the first longitudinal end, at a downstream end of the curved portion and integrally extends from a corresponding second projection of each of the two or more flow guides, the first longitudinal end being separated in the longitudinal direction from an upstream end of the curved portion of a corresponding flow guide of the two or more flow guides, wherein the first longitudinal end is disposed at a location longitudinally separated from the upstream end of the curved portion and the second longitudinal end is disposed at a location at the downstream end of the curved portion that is integrated a first longitudinal end of the corresponding second projection, wherein the first projection of each of the two or more flow guides is inclined at a predetermined angle from a center line of the nozzle body and is configured to guide the flow of the compressed air flowing on the curved portion in a desired direction according to the predetermined angle, and wherein the second projection of each of the two or more flow guides includes a first longitudinal end that is disposed at an stream end of the straight portion and integrally extends from a corresponding second longitudinal end of a first projection of each of the two or more flow guides and a second longitudinal end that is disposed opposite to the first longitudinal end of the second projection at a downstream end of the straight portion, the second longitudinal end of the second projection extending to an end of the downstream end of the straight portion and being in contact with the downstream end of the straight portion of a corresponding flow guide of the two or more flow guides without a gap.

17. The fuel nozzle assembly of claim 1, wherein the second projection of each of the two or more flow guides includes a first longitudinal end and a second longitudinal end disposed opposite to the first longitudinal end, wherein the first longitudinal end of the second projection of each of the two or more flow guides integrally extends from a corresponding first projection of each of the two or more flow guides, and wherein the second longitudinal end of the second projection of each of the two or more flow guides extends to a downstream end of the straight portion of a corresponding flow guide of the two or more flow guides.

* * * * *